US005743673A

United States Patent [19]

Bravo

[11] Patent Number: 5,743,673

[45] Date of Patent: Apr. 28, 1998

[54] WATERTIGHT SEALING SYSTEM WITH RELIEF VALVE FOR MANHOLE HAVING A SPILL BUCKET

[76] Inventor: Sergio M. Bravo, 2872 Tigertail Dr., Los Alamitos, Calif. 90720

[21] Appl. No.: 670,958

[22] Filed: Jun. 26, 1996

Related U.S. Application Data

[63] Continuation-in-part of Ser. No. 527,370, Sep. 12, 1995, Pat. No. 5,597,263, which is a continuation-in-part of Ser. No. 286,136, Aug. 4, 1994, Pat. No. 5,474,396.

[51] Int. Cl.[6] ..... E02D 29/14

[52] U.S. Cl. ..... 404/25; 52/20

[58] Field of Search ..... 404/25, 26; 52/19, 52/20

[56] References Cited

U.S. PATENT DOCUMENTS

| | | | |
|---|---|---|---|
| 3,712,009 | 1/1973 | Campagna | 404/25 X |
| 3,973,856 | 8/1976 | Gaglioti | 404/25 |
| 4,067,659 | 1/1978 | Campagna, Jr. et al. | 404/25 |
| 4,512,492 | 4/1985 | Graybeal | 404/25 X |
| 5,597,263 | 1/1997 | Bravo | 404/26 |

*Primary Examiner*—William P. Neuder
*Attorney, Agent, or Firm*—Christie, Parker & Hale LLP

[57] ABSTRACT

A sealing assembly for sealing a manhole against entering liquid includes a support ring fixed to the manhole's skirt and a sealing member resting on the support ring. The sealing member has a base with a foam ring under it, and pressing members on top of it for pressing the base against the support ring with the foam in between. The sealing member also has a top which is flexibly connected to the base. The top is fixed to the manhole cover with a gasket between it and the cover. A relief valve is provided to prevent the enclosed space within the manhole formed by the sealing member from overpressuring.

3 Claims, 15 Drawing Sheets

WATERTIGHT SEALING SYSTEM WITH RELIEF VALVE FOR MANHOLE HAVING A SPILL BUCKET

CROSS-REFERENCE TO RELATED APPLICATIONS

This application is a continuation-in-part of pending application Ser. No. 08/527,370, filed Sep. 12, 1995, now U.S. Pat. No. 5,597,263, which is a continuation-in-part of application Ser. No. 08/286,136, filed Aug. 4, 1994, U.S. Pat. No. 5,474,396.

FIELD OF THE INVENTION

The present invention relates to watertight sealing systems for manholes, and, in particular, to a watertight sealing system which may easily be retrofit into an existing manhole and to a system which is simple and useful for initial installation.

BACKGROUND OF THE INVENTION

In gasoline service stations, there is normally a submersible pump for pumping gasoline from an underground storage tank to a gasoline-dispensing pump. This submersible pump is typically located in a manhole. The manhole is normally formed by a metal cylindrical container known as a manhole skirt having a substantially flat bottom and a top suitable for receiving a manhole cover. The submersible pump is located at the bottom of the manhole. To detect the presence of leaking gasoline which will collect within the manhole, a sensor is provided. It is desirable to make this sensor relatively sensitive to detect small amounts of gasoline to avoid accumulation of large amounts of gasoline and the obvious fire hazard. Unfortunately, the typical sensor cannot tell the difference between gasoline and other liquids such as water. Therefore, if the seal between the manhole and the manhole cover is not watertight, water can leak into the manhole and set off the sensor, which results in shutting down of the submersible pump. This is a problem not only if it rains, but also if a hose is used to wash down the pavement at the service station. When the submersible pump shuts down, customers will not be able to pump gasoline and will take their business elsewhere. Accordingly, to avoid the loss of customers as well as the inconvenience of having to reset the system or the hazard of deactivating the sensor, it would be desirable to prevent water from entering the manhole. Moreover, any water which gets into the system will be contaminated with gasoline and must be disposed of as a hazardous material, which is expensive. Furthermore, if water gets into the system and freezes, the expansion of the frozen water can damage pipes, the pump, sensor, or other components.

Entry of water into manholes of all types, such as for vapor recovery systems and fill pipes for gasoline storage tanks, telephone equipment and electrical equipment can be prevented with the invention. Water can damage such equipment, corrode it, and make it cumbersome and dangerous to work on such equipment.

SUMMARY OF THE INVENTION

In one embodiment, the present invention is a system for sealing a manhole against water or other liquids including an annular gasket, a setting ring or guide ring which can be biased outward against inner walls of the manhole, the gasket being disposed on top of the guide ring, and an expansion ring for contacting the inside of the gasket and compressing the gasket in a radially outward direction against the walls of the manhole. Preferably, caulking is used at the junction of the metal plate and the gasket and at the junction of the retainer ring and gasket.

According to a preferred embodiment, the guide ring includes a compressible outer ring and a metallic inner ring having set screws disposed therein. The set screws may be used to compress the compressible material and thus bias it in an outward direction to fix the retainer ring at a suitable height in the manhole where the gasket is to rest. The gasket also preferably includes a compressible material. These materials are preferably non-corrosive with regard to gasoline.

In a further preferred embodiment, the metal plate has a handle on its upper main surface and an openable/closable disk which may be opened to view the gasoline-handling equipment and sensor at the bottom of the manhole, and may be closed to reseal against liquid.

In another embodiment, a manhole skirt has a first inner shoulder for supporting a gasket on which a lid is placed, the lid being pressed against the gasket preferably by clips. There is a second inner shoulder for supporting the clips, and on which foam inserts may rest. There is a third shoulder for supporting the manhole cover. Preferably, a rigid bar extends diametrically across, and is supported between, a wall of the skirt between the second and third shoulders to protect the lid from impact if the manhole cover is dropped during removal or replacement.

In a still further embodiment, there is an apparatus for a manhole for gasoline handling equipment such as single or double fill pipes with a spill containment system, which apparatus includes a first or upper support element (top) with an opening or openings for aligning with the pipe or pipes, a second or lower support element (base) with an opening for the pipe or pipes, a flexible seal member extending between and fixed to the first and second support elements, the second support element having a flange extending around its periphery. The apparatus further includes a support ring fixed to a skirt of the manhole for supporting the flange, extendable/retractable wedging or pressing elements for pressing the flange against the supporting ring, preferably with a foam or rubber gasket therebetween. The wedging elements can press against part of the manhole skirt or another supporting ring.

The above embodiments each describe a device for sealing a manhole to prevent water or other contaminants from collecting at the gasoline handling equipment located at the bottom of the manhole. In sealing a manhole with such a device, an enclosed space is formed at the bottom of the manhole around the gasoline handling equipment. If any gasoline were to leak into this enclosed space, there is a danger that the high vapor pressure components of the leaking gasoline may cause the pressure of the enclosed space to rise. If the pressure were to rise high enough, gaskets or other parts of the equipment forming the seal could be damaged, or could even be forcibly ejected from the manhole. Therefore, in the preferred embodiments, a pressure relief valve is provided to allow the enclosed space to safely vent any fumes that collect. By safely venting the fumes, damage to the equipment can be avoided.

BRIEF DESCRIPTION OF THE DRAWINGS

A better understanding of the invention and its advantages will be gained by reading the detailed description below in conjunction with the drawings in which.

DETAILED DESCRIPTION OF THE PREFERRED EMBODIMENTS

Figure 1:
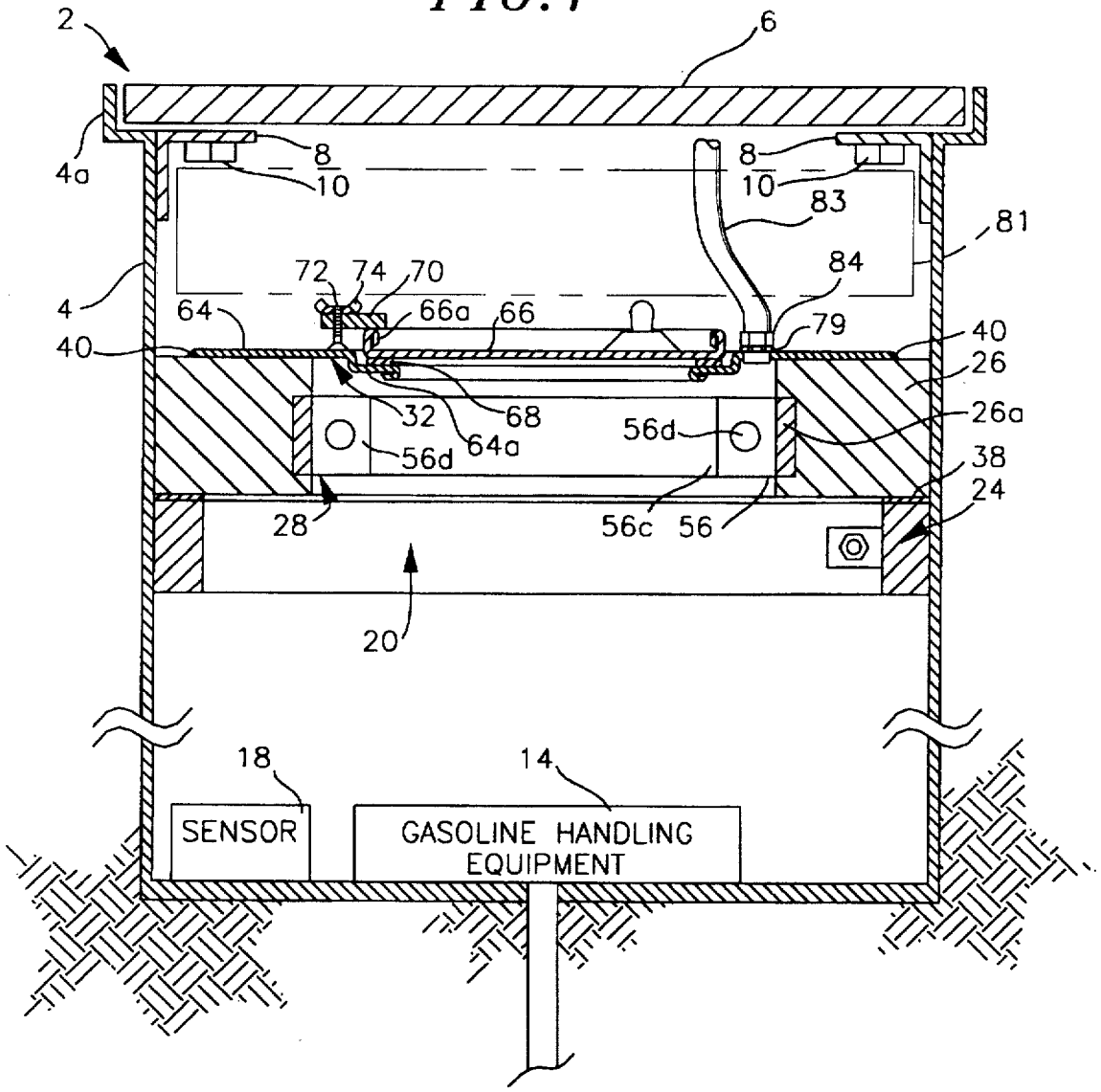
FIG. 1 is a sectional view of a manhole including a sealing system according to the invention.

In one preferred embodiment, a sealing system for a manhole against entry of liquids is disposed inside the manhole below the manhole cover. With reference to FIG. 1, a manhole generally indicated by reference numeral 2 includes a manhole skirt 4 having a manhole ring 4*a* at its upper periphery for receiving a manhole cover 6. The skirt 4 is disposed in the ground of a service station (not shown). Cover 6 is preferably flush with the cement surface of the station. The cover 6 may have several small sections of angle iron 8 connected to its underside by bolts 10, or the angle iron may be annular in shape. This helps seat the cover with the manhole skirt.

At the bottom of the manhole, there is gasoline-handling equipment 14 which typically is a submersible pump for pumping gasoline from the underground storage tank to the gasoline dispensing pumps. A sensor 18 is also located at the bottom of the manhole to detect the presence of leaking gasoline. Unfortunately, typical sensors cannot tell the difference between different liquids, so if water gets into the manhole, sensor 18 will be triggered. The station's pumps will be either manually shut down by the station operator in response to seeing an indication that the sensor has sensed liquid, or automatically shut down if the sensor is connected to an automatic shut-off switch or valve.

Also shown in FIG. 1 is the sealing system according to the invention, generally indicated by reference numeral 20. The sealing system 20 includes an annular retainer ring or guide ring 24 for supporting a rubber gasket 26. There is also an expansion ring 28 for pressing radially outward on the rubber gasket, and a lid 32 disposed on top of the gasket. Caulking 38, 40 may be provided between the retainer ring 24 and the gasket 26 and on top of the gasket 26 at the periphery of the lid 32. Gasket 26 has an annular recess 26*a* for receiving the expansion ring 28 to seat it securely.

Figure 2:
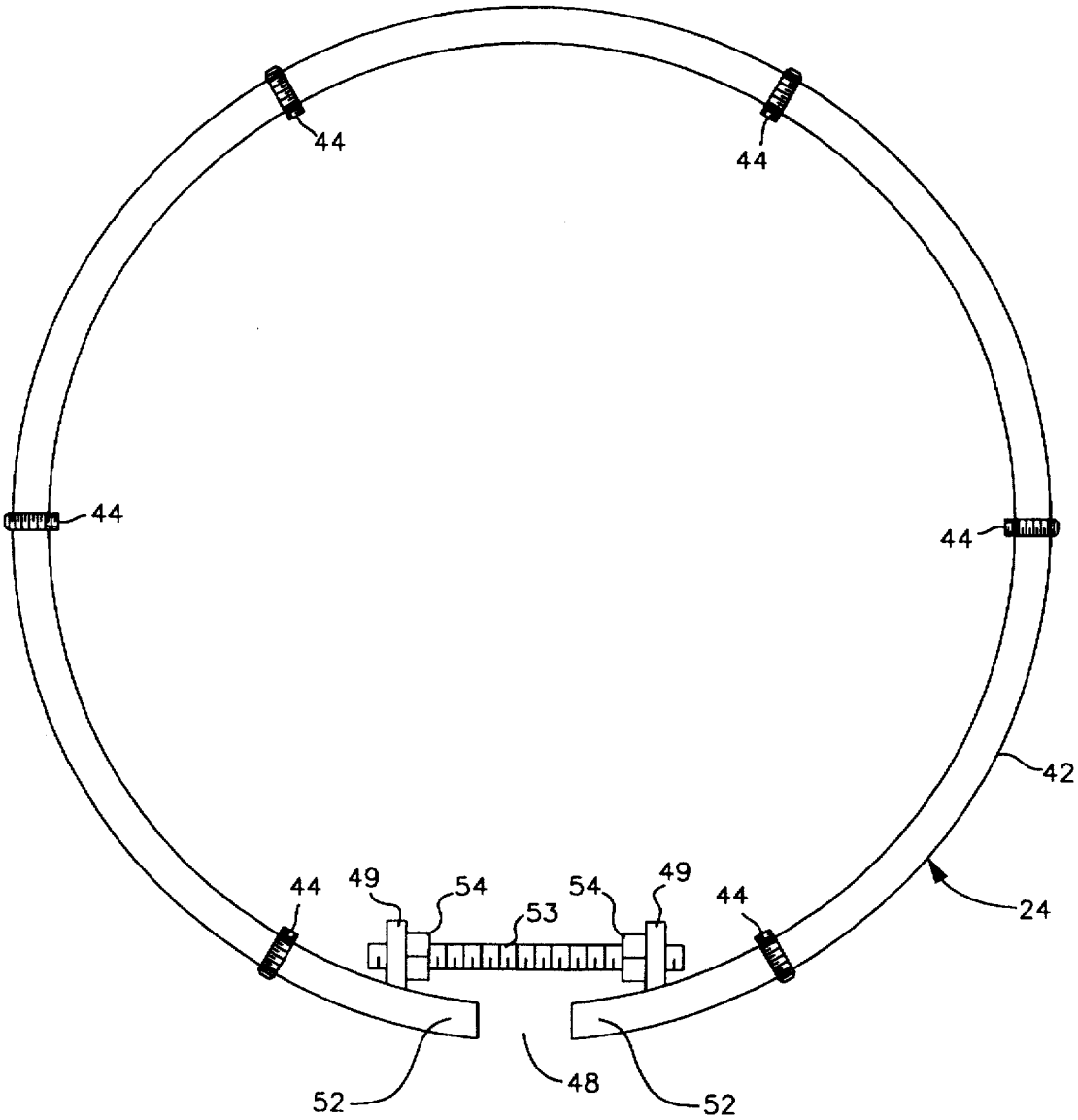
FIG. 2 is a top view of a guide or retainer ring in the sealing system of FIG. 1.
Figure 3:
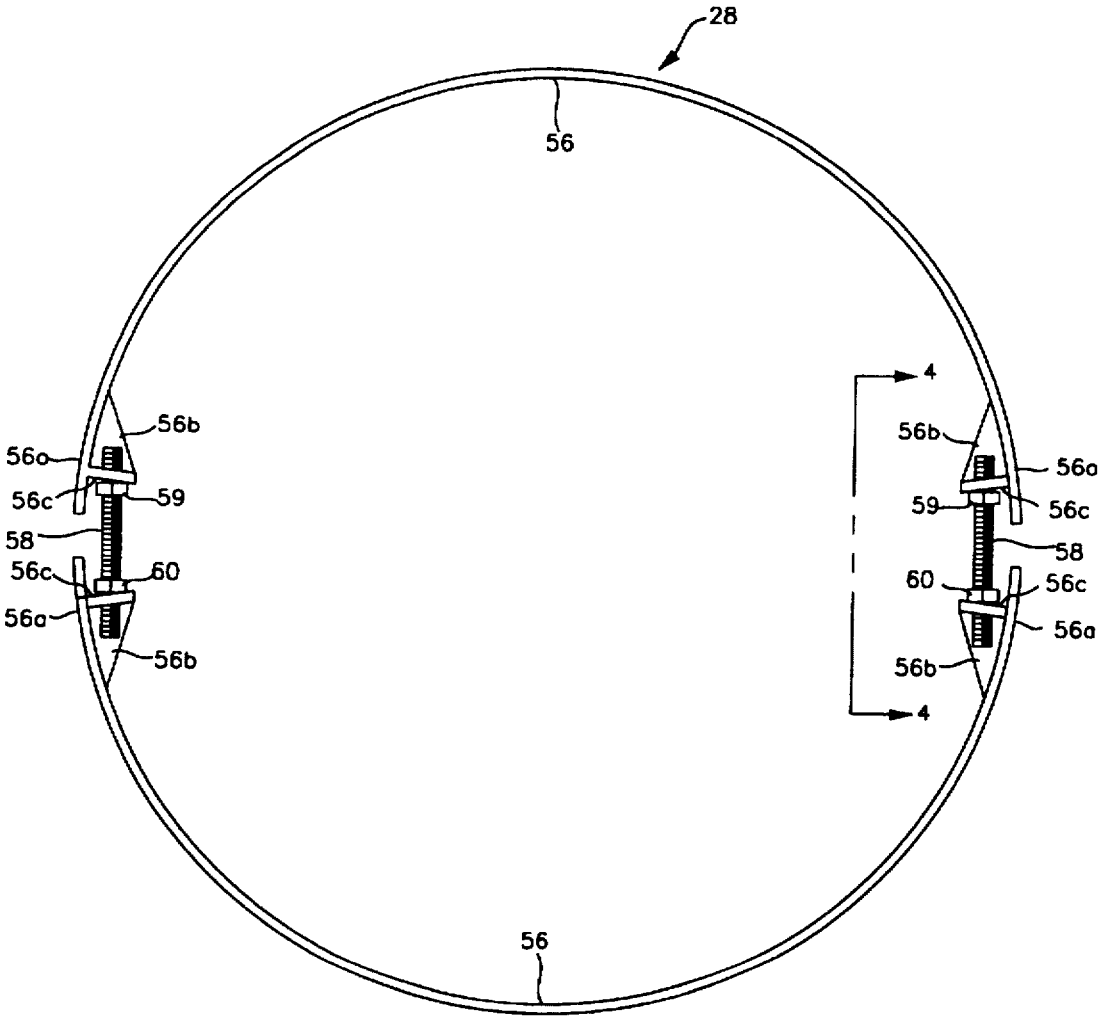
FIG. 3 is a top view an expansion ring of the sealing system of FIG. 1.

Details of the retainer ring 24 are shown in FIGS. 2 and 3. The ring preferably comprises an annular body 42 preferably of steel, and a plurality of set screws 44 passing through the body 42 which may be actuated to press radially outwardly against the manhole skirt 4 to fix the position of the ring 24. The body 42 preferably has a small gap 48 in it to allow the ring to be retracted or expanded to fit within manhole skirts of varying sizes. Two small metal plates 49 are fixed, e.g., by welding, to an inner edge of body 42 adjacent gap 48 on each side of the gap. Each plate 49 has a hole for receiving a bolt 53 and nuts 54 are provided for fastening each plate 49 to the body 42 at a desired location. By rotating the nuts so that they move away from each other one can make the body 42 substantially equal in outer periphery to the inner periphery of the manhole skirt, at which point the set screws 44 may be rotated to press outwardly against the manhole skirt and thereby fix the retainer ring in position.

Gasket 26 is preferably of an elastomeric material or any other material capable of providing a sufficient seal against liquid when pressed outward against the walls of the manhole by the expansion ring 28. An example of such an elastomeric material is neoprene with an HR index of about 50 or 60 or more.

Figure 4:
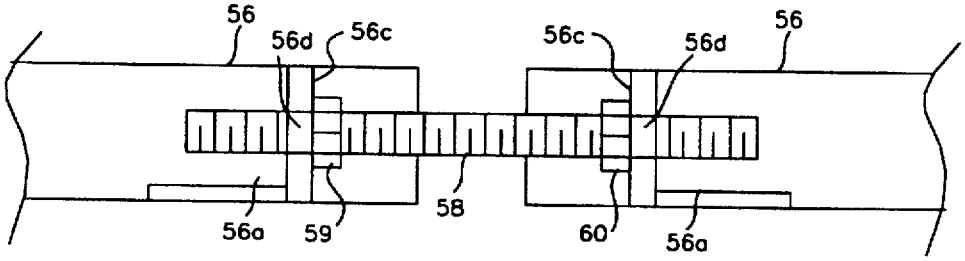
FIG. 4 is a side view of a portion of the expansion ring of FIG. 3 taken along line 4—4.

Details of expansion ring 28 are shown in FIGS. 3 and 4. Ring 28 includes two substantially semicircular actuating bodies 56 with integrally or unitarily formed brackets 56*a* at their ends which include a web 56*b* for reinforcement and a perpendicular tab 56*c* so that bolts 58 may be fitted through holes 56*b* in each tab 56*c*. The web need not be provided unless reinforcement is needed. Nuts 59, 60 are threaded on the bolts 58. These nuts 59, 60 may be adjusted towards each other or away from each other to tension or reduce tension on the expansion ring during installation in the same manner as for the ring 24. Reducing tension enables the expansion ring to fit inside the periphery of the rubber gasket 26 and then the nuts are tightened to have the expansion ring 28 sit in the recess 26*a* and press against the rubber gasket 26 to form the seal. The expansion ring, like the retainer ring, is preferably steel with epoxy paint.

Figure 5:
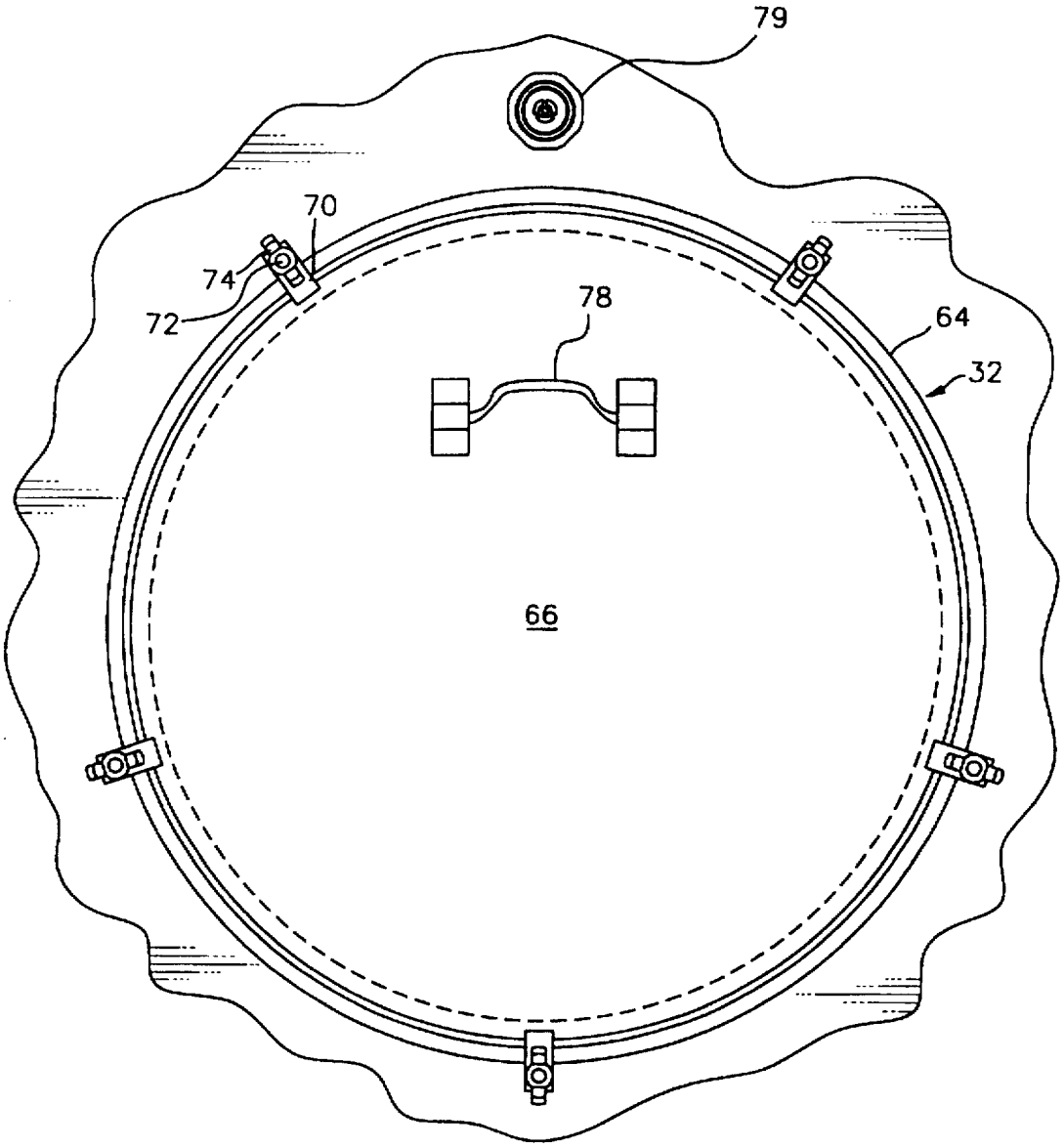
FIG. 5 is a top view of a metal lid of the sealing system of FIG. 1.
Figure 6:
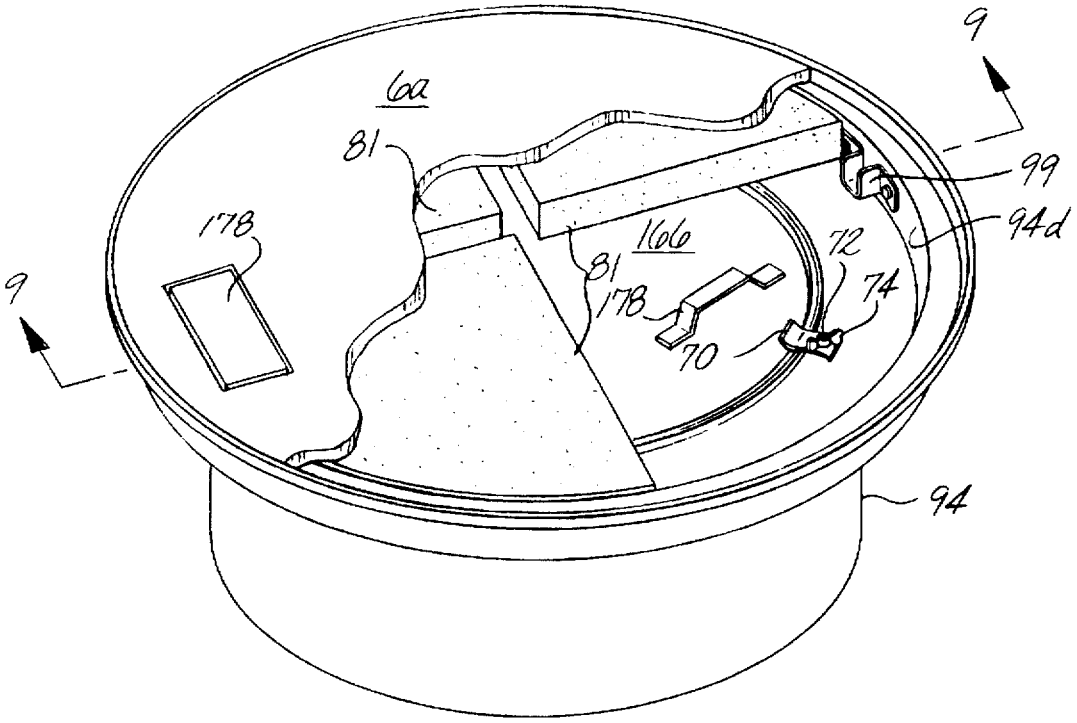
FIG. 6 is a top view of a manhole, with a manhole cover cut away and including a sealing system according to a further embodiment of the invention.

Details of lid 32 are shown in FIGS. 1 and 5. There is a large annular ring 64 and an inner disk 66 removably sealed to the outer ring 64, by means of an annular gasket 68 sitting in a lip 64*a* of the outer annular disk 64. The inner disk 66 has a tab edge 66*a* at which point a plurality of metal clips 70 press down on the disk 66 by means of bolts 72 welded or otherwise secured to the annular ring 64. The bolts 72 pass through the metal clips and are actuated by wing nuts 74 tightened on the bolts 72. With this structure, the wing nuts 74 may be loosened so that disk 66 can be removed to inspect and otherwise have access to the sensor 18 and gasoline-handling equipment 14, without disturbing the caulking 40 used to seal the annular ring 64 to the gasket 26. A handle 78 may be provided on the disk 66 to simplify lifting up and replacing the disk.

When the sealing assembly is properly installed, an enclosed space is created at the bottom of the manhole where the gasoline handling equipment is located. In the preferred embodiment, a suitable pressure relief valve 79, as shown in FIG. 1, is provided to prevent a hazardous situation from developing. For this embodiment, the relief valve is provided at the lid 32 of the sealing assembly. If the pressure within the enclosed space formed by the sealing assembly rises above a predetermined limit, the pressure will be vented to the upper portion of the manhole. Such a relief valve is useful, for example, if gasoline were to collect in the enclosed space and cause the pressure in the enclosed space to rise due to the vaporization of the volatile components of the leaking gasoline. Preferably, the relief valve is designed to open at a fairly low pressure such as ½–1 psi, so as to prevent any significant pressure rise to occur in the enclosed space. A length of conduit or flexible tubing 83, such as ordinary garden hose is connected to an upper threaded portion of the relief valve by a conventional female hose fitting 84 and extends up to near the bottom of the manhole cover to prevent any liquid from collecting at the outlet for the relief valve. Of course, if water were to collect at its outlet, the pressure required to open the relief valve would be undesirably increased. Preferably, the flexible tubing extends up to within an inch of the bottom of the manhole cover.

Figure 17:
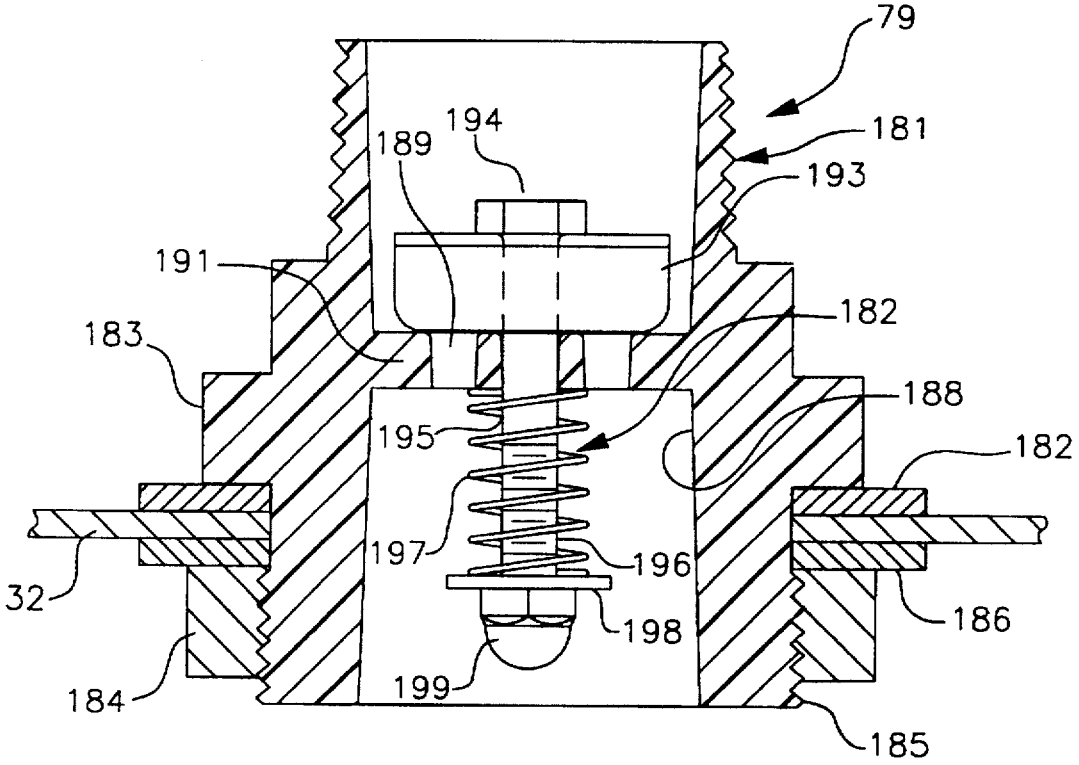
FIG. 17 is a sectional side view of a portion of the manhole sealing system of FIG. 1 illustrating the details of a relief valve.
Figure 18:
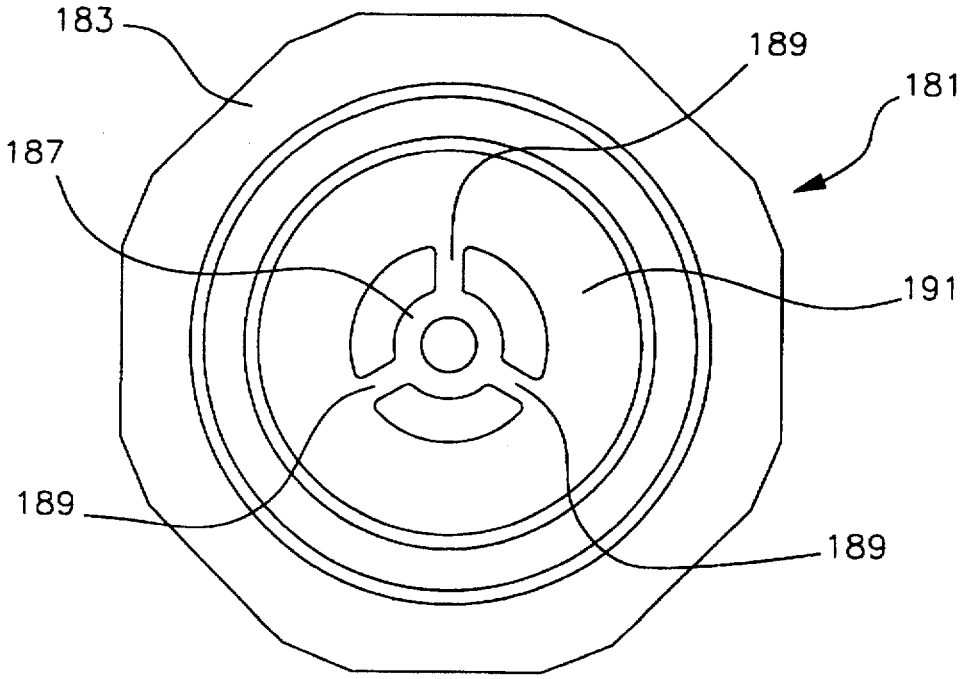
FIG. 18 is a top view of a relief valve body.

While any conventional pressure relief valve with an appropriate pressure setting may be used, a preferred relief valve is illustrated in FIGS. 17 and 18. The relief valve includes a generally cylindrical valve body 181 that extends through a hole in the lid. A gasket 182 is placed between the upper side of the lid and a flange 183 on the valve body to seal the hole. A nut 184 is threaded over a lower threaded portion 185 of the valve body to hold the valve body in position on the lid. A washer 186 is also provided between the nut and the lid.

The valve body includes an inner guide 187 which is attached to the inner wall 188 of the valve body by a plurality of arms 189. Preferably three arms extend outwardly from the inner guide to the inner wall of the valve body in a spoked arrangement. A seating ring 191 is also provided on the inner wall of the valve body. Preferably, the entire valve body including flange, guide, arms and seating ring, are provided as an integral unit made of a durable corrosion-resistant and hydrocarbon-resistant acetal copolymer such as a product sold under the name Celcon®.

A poppet valve 192 is mounted in the valve body and includes a sealing disk 193 through which a bolt 194 having a shaft 195 with a threaded end 196 is inserted. The shaft of the bolt is slidably mounted through the inner guide of the valve body and a spring 197 biases the poppet valve in a downward direction against a washer 198 and acorn nut 199 threaded over the threaded end of the bolt. The poppet valve and valve body form a positive seal by the sealing disk mating with the seating ring. The spring is selected so as to bias the poppet valve in a normally closed position. If the pressure within the enclosed space builds up, the sealing disk will be pushed in an upward direction away from the valve seat in order to allow flow of gas from the enclosed space, through the valve body to relieve the pressure. Once the pressure has been relieved, the spring biases the sealing disk back into its closed position against the valve seat. Preferably, the relief valve is sized so that the surface area of the disk and the tension of the spring are balanced to allow the relief valve to open when the pressure within the enclosed space exceed about ½–1 psi. The flow path through the relief valve must also be properly sized so as to permit an appropriate volume of gas to rapidly pass through the valve body in an overpressure situation. The various components of the relief valve are preferably made of a corrosion resistant material that is also resistant to hydrocarbons. Suitable materials include durable plastics and stainless steel.

To install the sealing assembly in the manhole, manhole cover 6 is removed and the depth of the assembly, i.e., the depth at which the retainer ring 24 must be installed, is preferably marked on the manhole skirt. One way to do this is by means of a substantially L-shaped tool where one end of the L carries a marking utensil and the other part of the L is used as a guide flush with the surface of the service station. When the tool is moved in a circle around the surface of the service station, the marking utensil marks the appropriate depth of installation on the inside of the manhole skirt. Preferably, the marking utensil is telescopically attached to the L-shaped tool so that the desired depth at which the tool will mark a circle around the manhole skirt may be adjusted as needed for the particular installation.

The annular ring is placed inside the manhole and positioned in line with the markings. The body 42 is expanded or contracted to provide a rough fit. If gap 48 does not provide enough play to reduce the size of the body 42 to fit the diameter of the manhole skirt, some of the body 42 can be cut off one of the ends 52 of the body. When body 42 is in rough position, bolt 53 is tightened using the nuts 54 and then set screws 44 are actuated to press outwardly and fix the position of the ring. (The expansion ring, and other elements, are preferably manufactured in different size increments, such as 31", 32", 33", and 34" diameters to fit most or all size manholes with limited adjustments.) The caulking 38 may then be provided on top of the retainer ring and then the rubber gasket is placed on top of that. The expansion ring 28 is then positioned at the inner periphery of gasket 26 and the nuts 59, 60 are rotated away from each other to tension the ring 28 and force the gasket 26 against the manhole skirt 4 to form a seal. The lid 32 is then placed on top of the gasket 26 and caulking 40 may be used around the periphery of the lid.

Preferably, the height of installation of the sealing ring is selected so that there is between 1 and 2 inches of clearance to the manhole cover, so that only a minimum of water can collect above the sealing assembly. Moreover, it is preferable to install foam 81, such as styrofoam, between the cover and lid to further minimize water collection and to help minimize the effects, if any, of freezing and thawing. The foam is preferably formed in four quarters.

Another embodiment of the invention is shown in FIGS. 6–9 in which like reference numerals represent like elements from prior embodiments. This embodiment is useful where the entire manhole and skirt are being installed. There is a skirt with a unitarily formed first shoulder for receiving a gasket upon which the lid is placed so as to eliminate the need for a guide ring, expandable ring, and additional gasket. This embodiment has the advantage that there are fewer parts.

Figure 7:
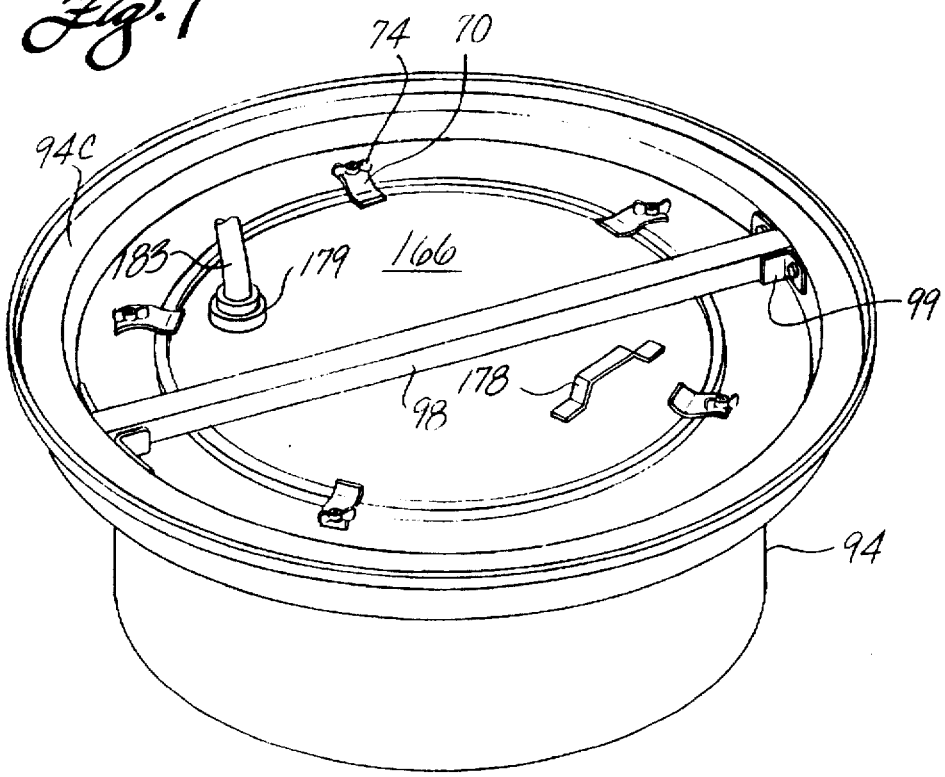
FIG. 7 is a top view of the manhole of FIG. 6 with the manhole cover and foam removed.
Figure 8:
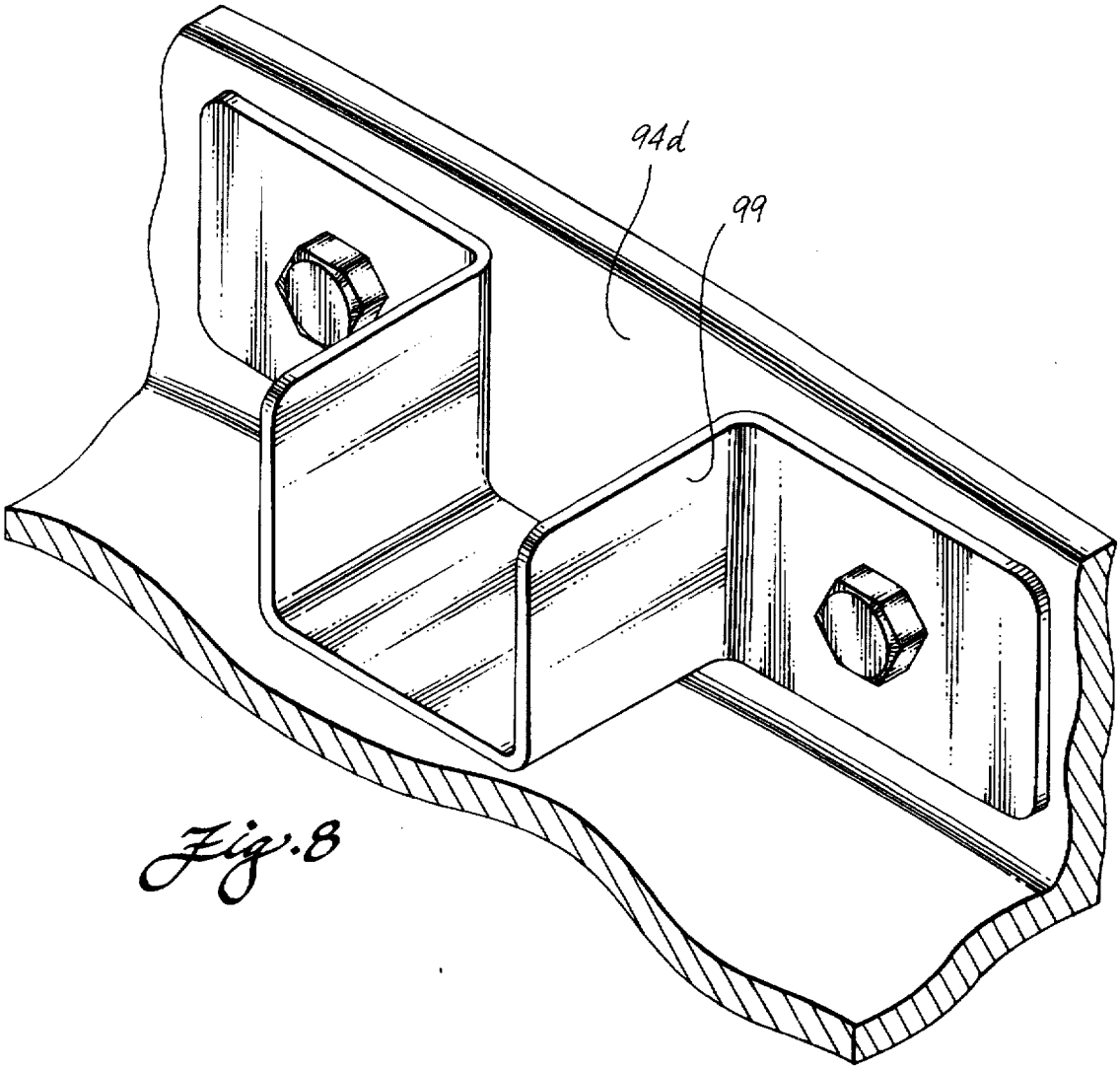
FIG. 8 is an enlarged side view of a bracket used to support a bar inside the manhole of FIG. 6.
Figure 9:
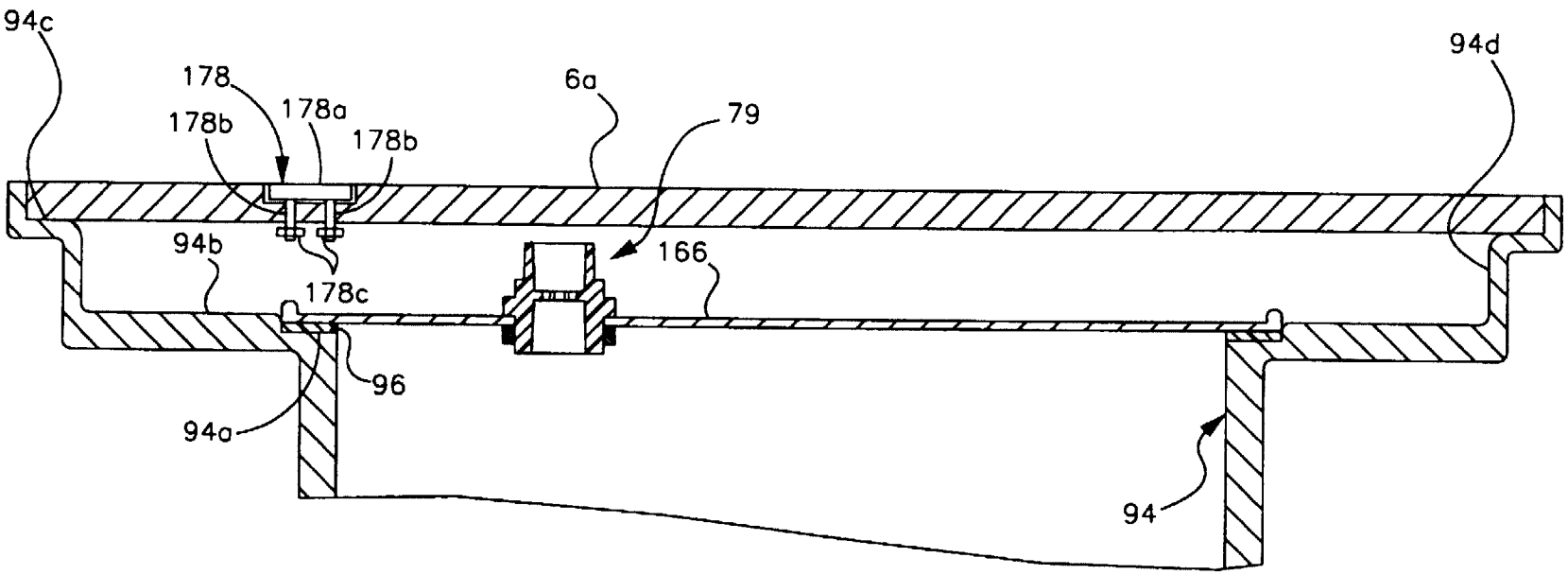
FIG. 9 is a vertical sectional view of the manhole of FIG. 6 without foam.

Specifically, there is a manhole cover **6*a* and skirt 94, having a first shoulder 94*a* on which a gasket 96 rests (FIG. 9). The skirt has a second shoulder 94*b* to which several metal clips 70 are bolted by bolts 72 in such a way that they may be tightened by wing nuts 74. These clips 70 thus press a lid 166 against the gasket 96 to provide a watertight seal. A pressure relief valve 179 as previously described is provided on the lid so as to prevent the enclosed space formed by the lid from overpressuring. A length of flexible tubing 180** extends from the relief valve up to near the bottom of the manhole cover to prevent water or other material from collecting in the relief valve outlet. The lid 166 can have a handle 178. On top of the lid, a piece or pieces of styrofoam 81 (shown in FIGS. 6 and 9) are provided. While the relief valve and tubing are not illustrated in FIG. 6, it is clear that one of the styrofoam pieces can include a hole for receiving the tubing, or the tubing can pass upward through the gap between a pair of adjacent pieces of styrofoam. The skirt has a third shoulder 94c which is also integrally formed, and which supports the cover 6a. A square or rectangular bar 98 is provided on supporting brackets 99 screwed, bolted or welded to the wall 94d between the second and third shoulders 94b, 94c. The actual shape of the bar is not critical, but it serves to prevent the preferably lightweight (e.g., aluminum) lid 166 from being dented or otherwise impacted by the manhole cover 6a in the event that the cover slips during removal or replacement. To further simplify removal and replacement of the cover 6a, it is preferred to install a retractable handle 178 formed, e.g., by a metal plate 178a, two threaded rods 178b bolted to the underside of the plate and two nuts 178c to limit the movement of the plate. The plate sits in a recess formed in the cover. FIG. 7 shows a top view with the cover and foam removed, and FIG. 8 shows an enlarged view of one of the supporting brackets 99 for the bar 98. The bar also serves to simplify removal and replacement of the cover by allowing the cover to be easily slid.

This embodiment eliminates the retention ring, additional gasket, and expansion ring of the above embodiments because it is all unitary with the new manhole skirt. The skirt is preferably galvanized steel, and the foam is preferably formed in one-quarter or pie-shaped segments. Closed cell styrofoam will eliminate approximately 80% of the possible water buildup and thus will minimize any expansion of the water when it forms ice.

Where the manhole is for a subunit area or fuel tank access area, another embodiment of the invention may be used. Examples are shown in FIGS. 10a, 10b and 11a, 11b.

Figure 10A:
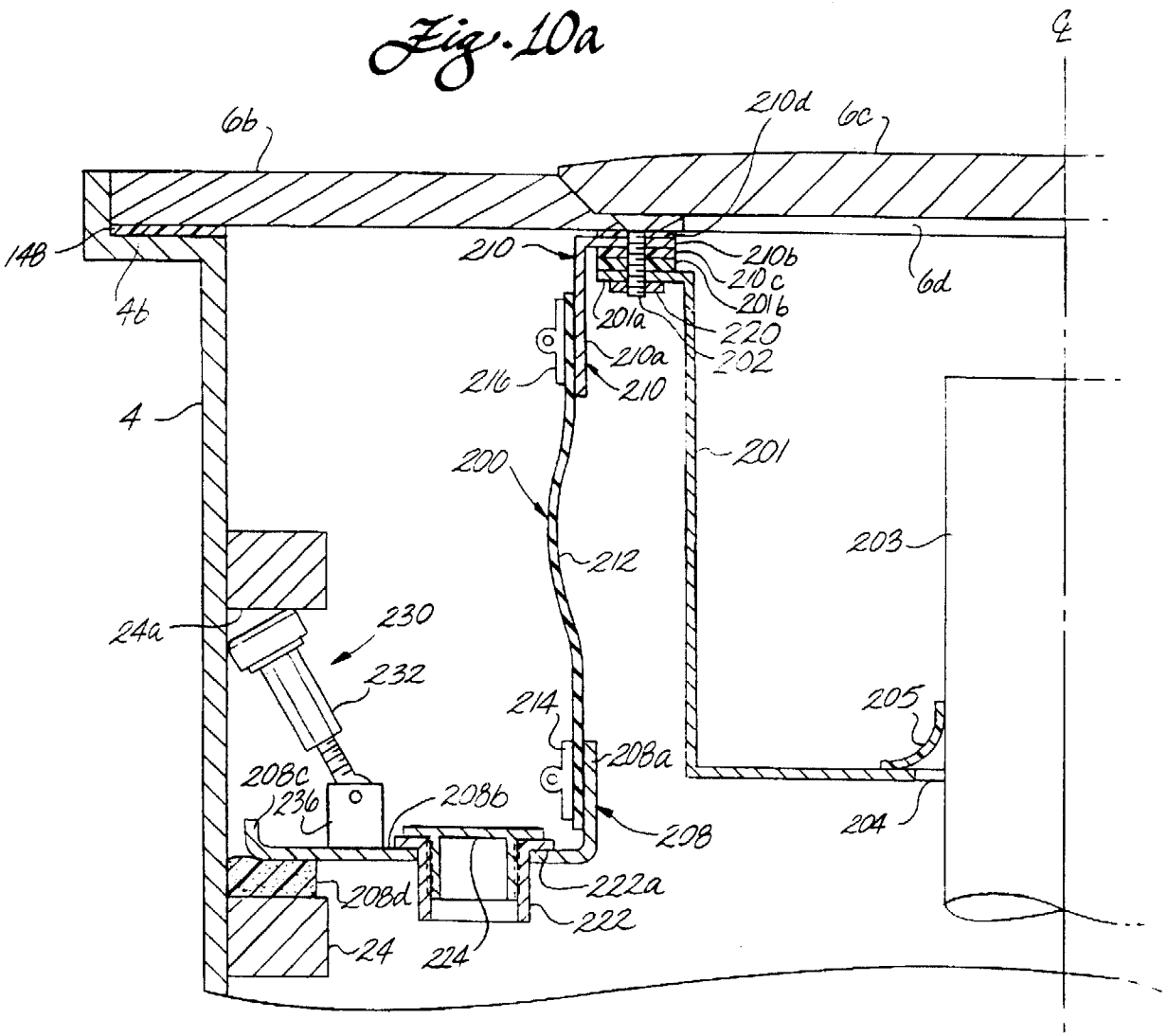
FIGS. 10*a* and 10*b* are vertical left and right side sectional views similar to FIG. 9, but showing a variation thereof.
Figure 10B:
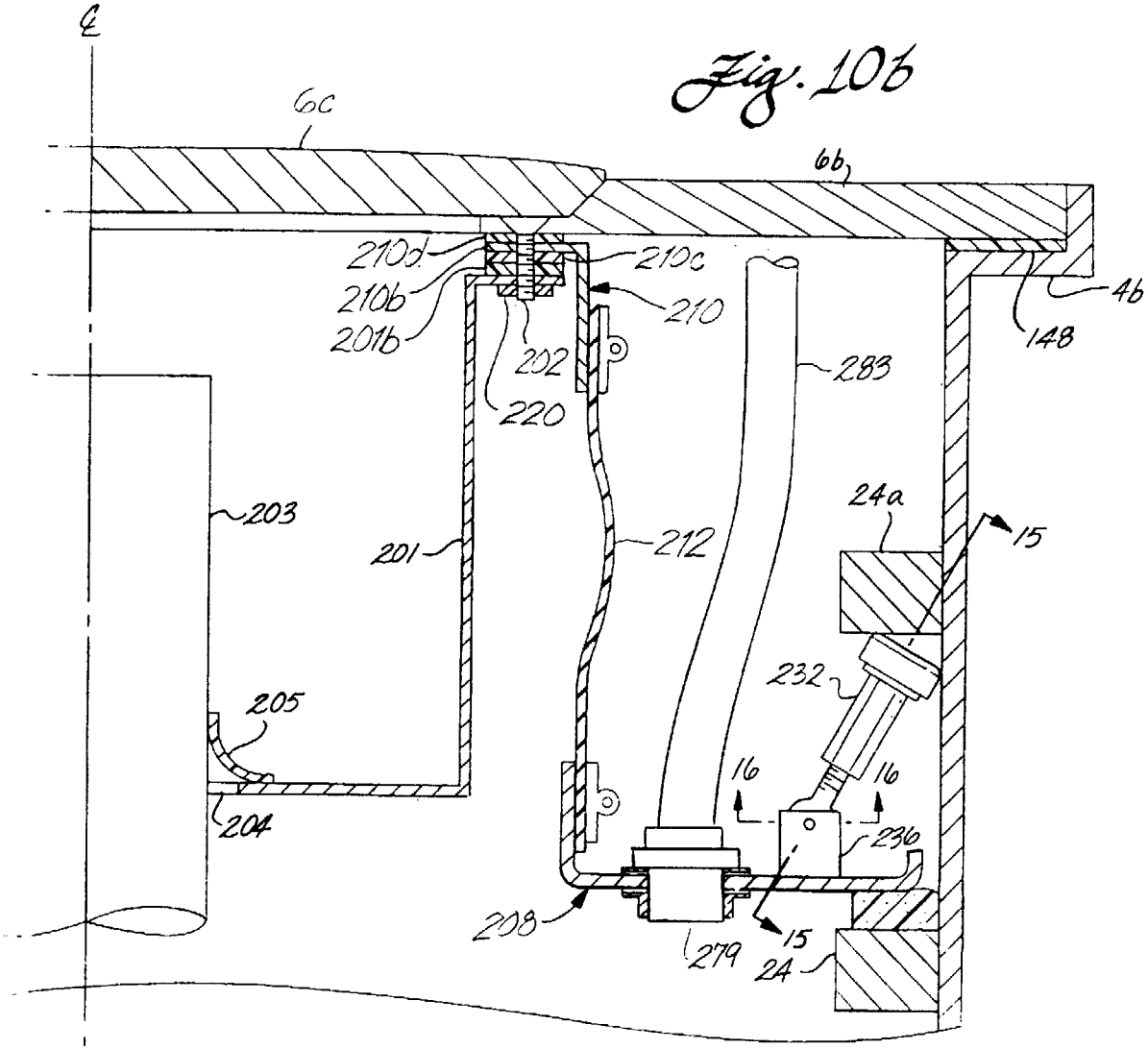

In these embodiments, like reference numerals represent like elements. In FIGS. 10a and 10b, an annular gasket 148 helps provide a seal between manhole cover 6b and manhole skirt 4. Gasket 148 sits on an annular shoulder 4b of the skirt. As is conventional, cover 6b has an openable lid 6c. It is also conventional to provide a spill containment bucket 201. The bucket is normally mounted to the underside of cover 6b by bolts with a gasket 201b between the lip 201a of the bucket and the underside of the cover 6b or between the lip 201a and a mounting plate fixed to the underside of the cover, e.g., by welding. The bucket 201 has a central opening 204 for a fuel fill pipe 203 ("riser") to pass through. The bucket 201 may have apparatus to mount itself on the fuel pipe which pipe would still be accessible through the central opening. This apparatus may even include a drain valve (not shown). An example of a spill containment bucket such as above including a cover, openable lid and flexible sides is a POMECO 511 Multi-Port Spill Containment Manhole sold by OPW of Cincinnati, Ohio. The bucket is shown in these drawings with nonflexible sides and with rubber sealing flaps 205 for the sake of simplicity, since the bucket itself is known in the art.

In this embodiment, a seal unit or member 200 is provided to seal the portion of the manhole which is not sealed by the spill bucket. The seal member includes a lower support or base 208, an upper support or top 210 and a flexible hose 212 fixed by two band clamps 214, 216 to vertical flanges 208a, 210a of the base and top 208, 210, respectively. The base and top 208, 210 and the hose 212 are all annular. The hose is flexible to provide slack for the distance between the spill bucket's lips and the sealing ring and can help accommodate freezing of liquid and expansion thereof.

The top 210 has a horizontal flange 210b for fixing the seal member to the underside of cover 6b. The horizontal flange 210b has an annular foam rubber pad 210c adhered to its underside and an annular rubber gasket 210d adhered to its top. The connection and seal are made by unbolting the spill bucket lip 201a and gasket 201b, replacing the bolt with a longer bolt 202 (if necessary), slipping the top member 210 onto the bolt with the gasket 210d pressed against the underside of the cover 6b (or plate welded thereto), and then slipping the gasket 201b onto the bolt against the underside of the foam 210c, and finally putting the lip 201a of the spill bucket against the underside of the gasket 201b. Nut 220 is then applied to tighten and hold the assembly.

The base member 208 has an observation port formed in it by an internally threaded tube 222 with an upper lip 222a fixed to a horizontal part 208b of base member 208 and an externally threaded cap 224 threaded to tube 222. The base member 208 has an outer upwardly curved portion 208c to help guide the assembly during installation.

The underside of the horizontal part 208b has a foam ring 208d fixed to it for resting on and sealing against a retainer or support ring 24. On top of horizontal part 208b at multiple locations, e.g., six or eight places, is a pressing assembly 230 which includes a retainer or support ring 24a similar to ring 24, a pressing member 232 and a bracket 236 on which the pressing member is mounted. Each bracket 236 has a lower horizontal plate 236a at which it is fixed to the top of the horizontal part 208b of the base member, e.g., by welding, and a vertical plate 236b.

A relief valve 279 as previously described is provided on the base member to prevent the enclosed space formed by the installation of the sealing assembly from overpressuring. A length of flexible tubing 283 extends up from the relief valve outlet to near the bottom of the manhole cover to prevent liquid from collecting in the relief valve outlet.

Figure 15:
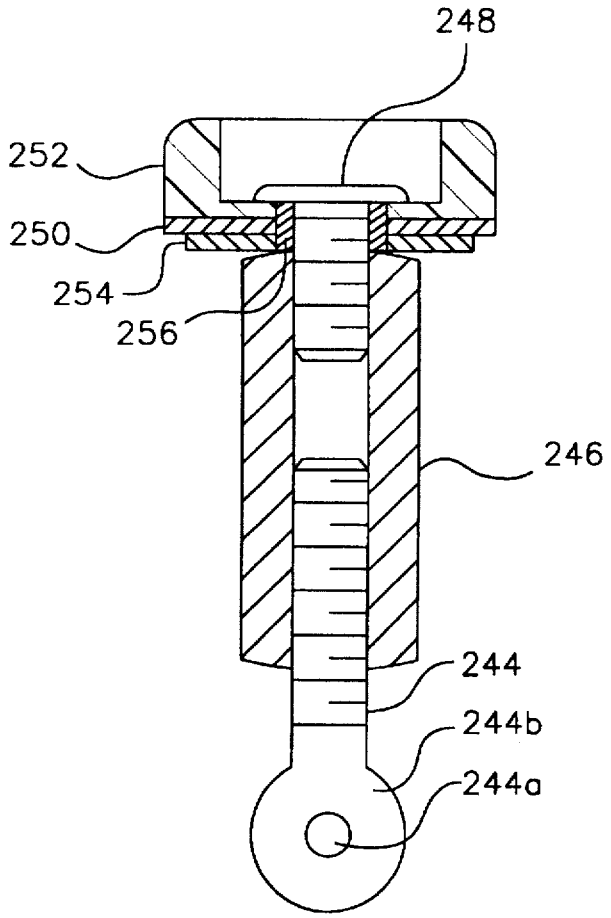
FIG. 15 is an enlarged partial sectional view of a pressing member or wedging element of the embodiments of FIGS. 10*a*, 10*b* and 11*a*, 11*b* taken along line 15—15 in FIG. 10*b;*
Figure 16:
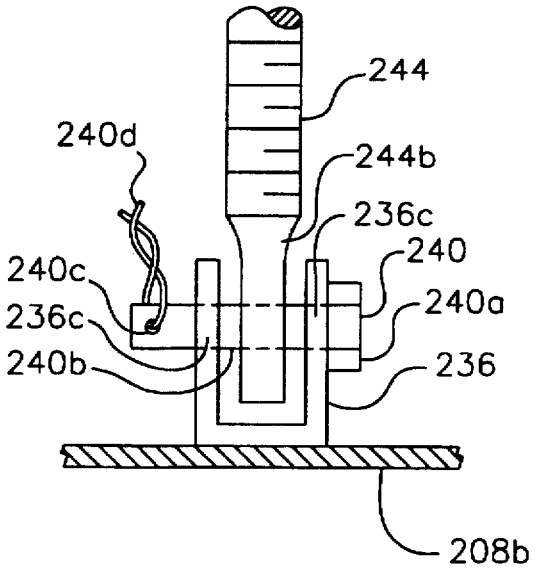
FIG. 16 is an enlarged side view of the pressing member and its connection to a bracket taken from circle 16 in FIG. 10*b;*

Details of the pressing member and bracket are shown in FIGS. 15 and 16. Each bracket 236 is made from channel stock with two holes 236c for receiving a locking pin 240. The pin 240 passes through holes 236c and through an aperture 244a in an eye end 244b of a threaded rod 244 of the pressing member. The locking pin has head 240a at one end of a shaft 240b and the shaft has a hole 240c at its opposite end. Wire 240d is put through the hole 240c and its ends twisted to hold the pin in place. The rod 244 threads inside an internally threaded sleeve 246. The sleeve has a bolt 248 also threaded into it from an end opposite the threaded rod 244. The bolt holds a metal ring 250, to which a rubber ring 252 is fixed, and a washer 254 against the sleeve. A metal cylinder 256 fits inside the washer 254 and ring 250 and around the shaft of the bolt. The sleeve 246 may be rotated in one direction or the other to lengthen or shorten the pressing member 232 and thus, when lengthened, will press the base 208 downward against annular foam 208d to provide a seal against the skirt and ring. The rubber top 252 of the pressing member will wedge against upper support ring 24a. If the skirt 4 has an inwardly protruding portion, the pressing member may be wedged against that protrusion eliminating the need for ring 24a.

Figure 11A:
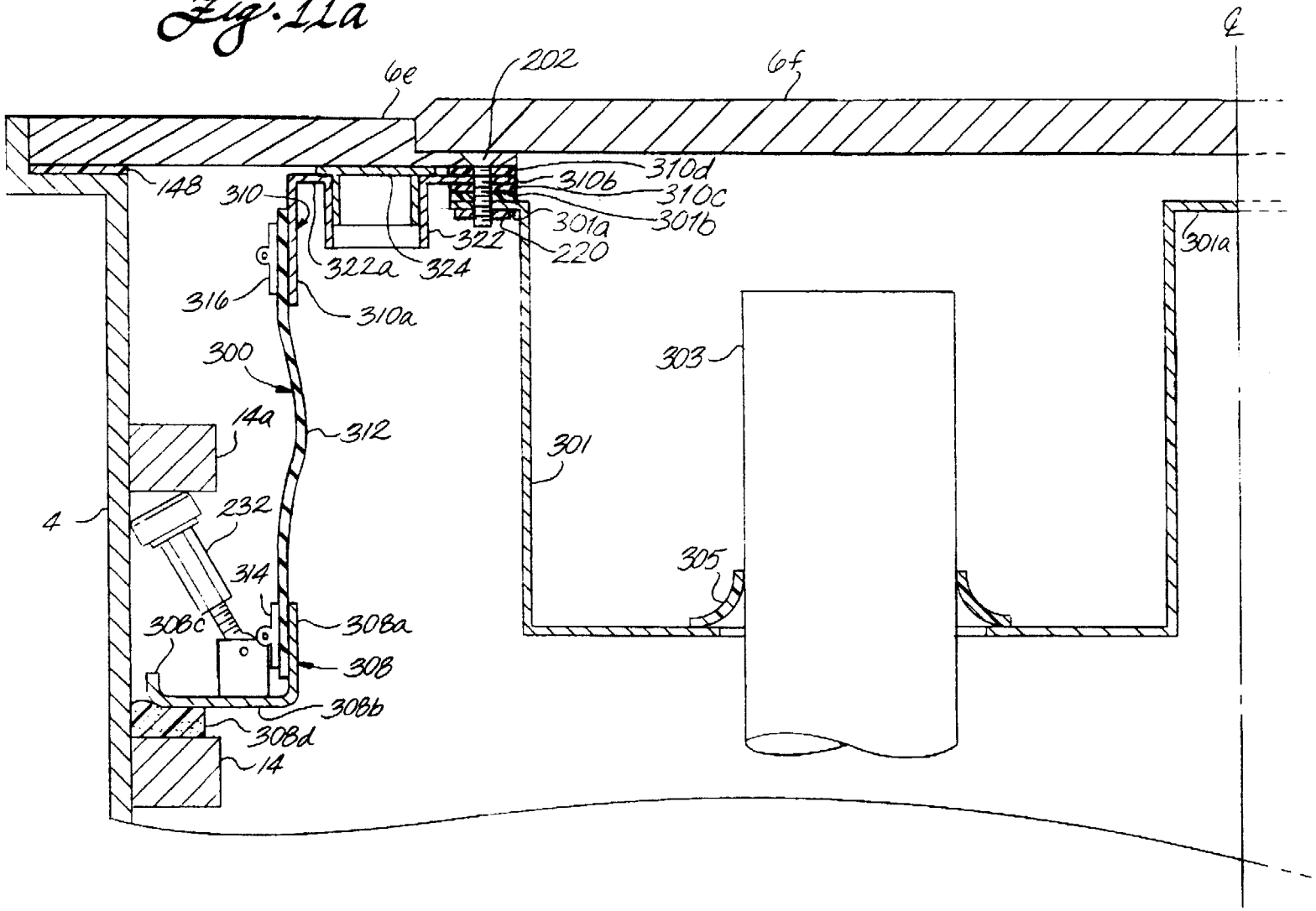
FIGS. 11*a* and 11*b* are left and right side sectional views of a variation of FIGS. 10*a* and 10*b;*
Figure 11B:
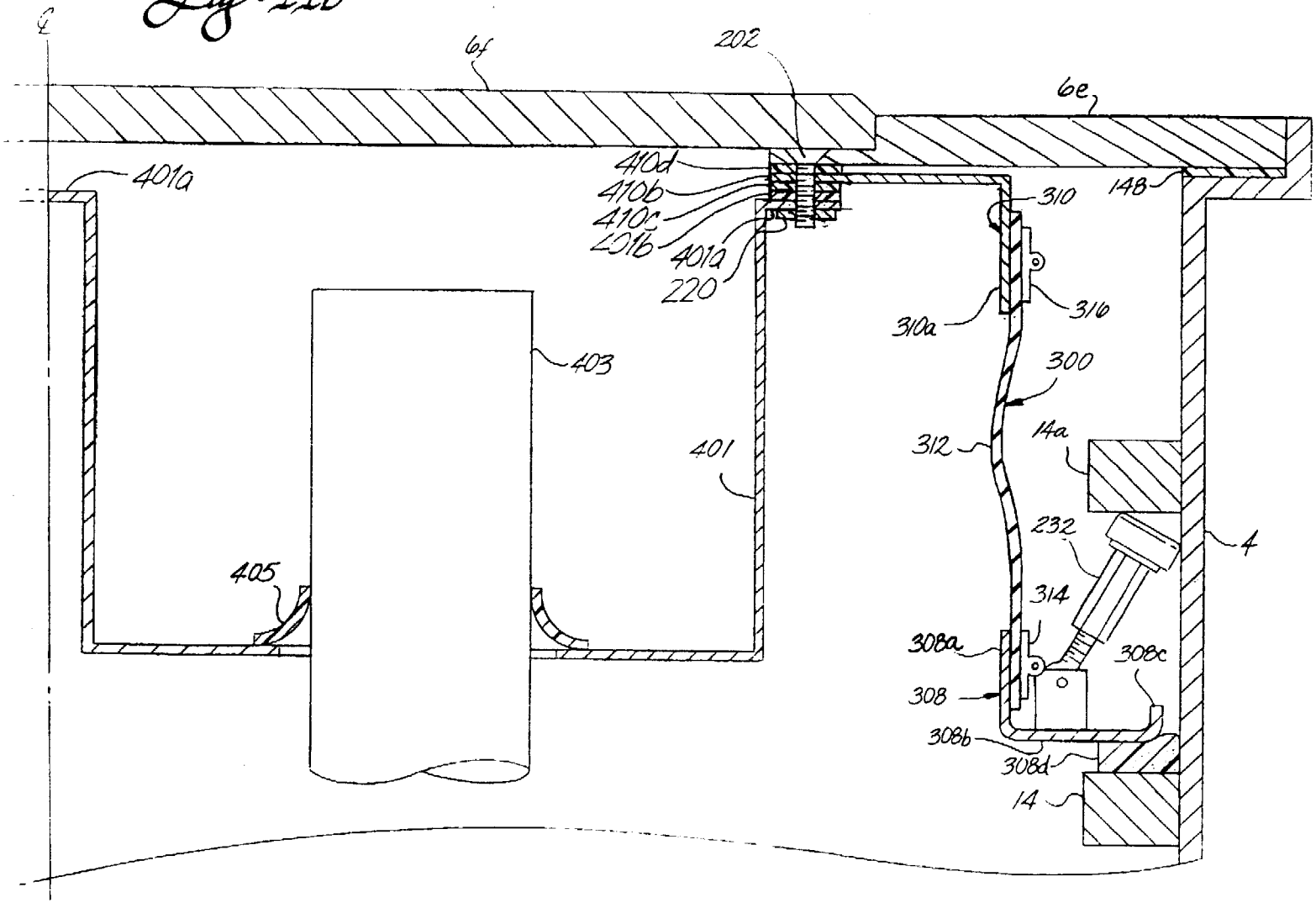

FIGS. 11a and 11b are similar to FIGS. 10a and 10b except that certain fuel risers are set in a manhole with a rectangular opening and thus use a rectangular spill containment box such as made by CNI Manufacturing of Irwindale, Calif. and known as a "FIL-SPIL CONTAINMENT BOX." In this embodiment, there are two pipes (risers) 303, 403, two containment boxes 301, 401 that may be joined at their lips 301a, 401a at adjacent locations. These lips at their nonadjacent peripheries are in a sandwich as in FIGS. 10*a*, 10*b*, i.e., a top support element 310 has a horizontal portion 310*b* which defines a rectangular opening for the containment boxes 301, 401. The portion 310*b* has a gasket 310*d* on top of it for pressing against the underside of cover 6*e* and a foam piece 310*c* below for pressing against a gasket 301*b* for the lips 301*a*, 401*a* which are below the gasket. All these pieces are in a "sandwich" held together by bolts 202 and nuts 220. In any of these embodiments, the stacking order in the "sandwich" can be adjusted as the need arises. For example, in the FIL-SPIL CONTAINMENT BOX, the lips 301*a*, 401*a* rest on the cover 6*e* and thus the lips would be above and outside of the sandwich. The sandwich is formed identically at the second box 401 by gasket 410*d*, lip 410*b*, foam 410*c*, gasket 401*b* and lip 401*a*. These gaskets, foam and lips may be formed in one piece with the gaskets, foam and lips around the outer periphery of box 301.

Seal assembly 300 is otherwise very similar to FIGS. 10*a*, 10*b* and has a base 308, a hose 312 fixed to flange 308*a* of the base and vertical flange 310*a* of the top by band clamps 314, 316, respectively. The base also includes a relief valve 379 and length of flexible tubing as previously described. Horizontal flange 308*b* of the base has foam 308*a* at its underside for sealing against ring 14 by means of the pressing member 232 and ring 14*a*. However, in this embodiment, there is normally more room to provide an observation port in the horizontal portion 310*b* of the top support than in the base support. The port is formed by an internally threaded cylinder 322 and an externally threaded cap 322.

Figure 12:
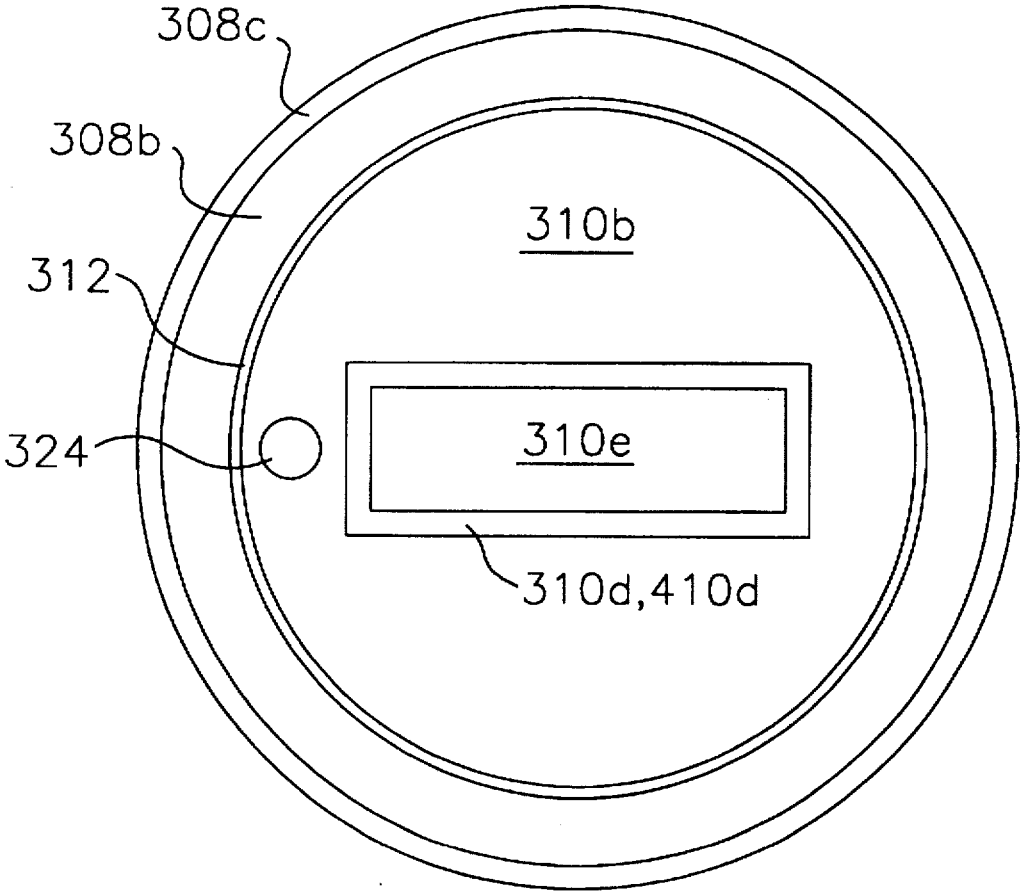
FIGS. 12 and 13 are schematic top views of part of the embodiments of FIGS. 11*a*, 11*b* and 10*a*, 10*b*, respectively.

FIG. 12 shows the seal assembly 300 of FIGS. 11*a*, 11*b* when looking down on it. Rectangular opening 310*e* for accommodating the fill pipes and containment boxes can clearly be seen. The brackets for mounting, e.g., six pressing members and the pressing members are not shown for the sake of simplicity. It is noted that the number of bolts 202 and nuts 220 around the foam 310*d* should be sufficient to provide an adequate seal.

Figure 13:
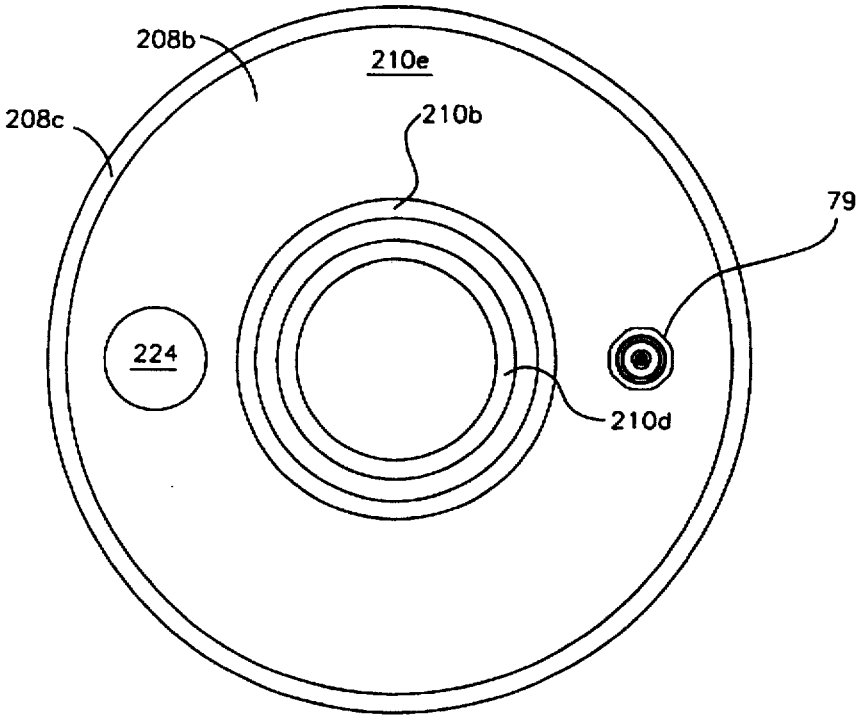

FIG. 13 shows the seal assembly 200 of FIGS. 10*a*, 10*b* when looking down on it. The round opening 210*e* defined by horizontal flange 210*b* (having foam 210*d* around its inner periphery) accommodates the fill pipe and round containment box.

Figure 14:
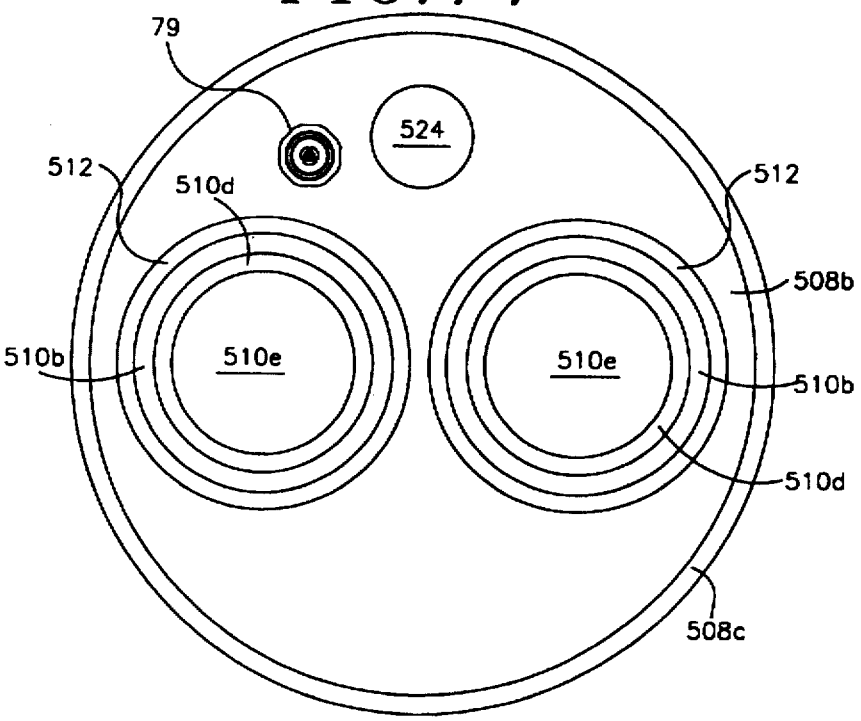
FIG. 14 is a schematic top view of a variation of the embodiments of FIGS. 10*a*, 10*b* and 11*a*, 11*b;*

FIG. 14 shows a possible further embodiment where the seal assembly accommodates two fill pipes with round containment boxes by means of two round openings 510*e* defined by foam 510*d* at the periphery of two annular top supporting elements having horizontal flanges 510*b* and having hoses 512 clamped to two annular vertical flanges (not shown) which are part of base 508. A relief valve 579 and a cap 524 for an observation port are shown. The base has an outer curved lip 508*c* as in other embodiments end seals to the ring 24 in the same manner as the other embodiments.

If, in the embodiment of FIGS. 11*a*, 11*b*, the containment boxes were not connected in water tight fashion to each other at their adjacent lips, then a two-opening rectangular version of FIG. 14 would be used to seal the manhole. One can envision several variations in number and shape of openings and number of risers to be accommodated.

The embodiments of the invention described herein are exemplary. For example, the manhole, and thus the various parts of the invention, may have a square or rectangular shape. The scope of the invention is not limited to such embodiments, but rather is defined by the appended claims as interpreted in accordance with law and equity.

What is claimed is:

1. An assembly for sealing a lower portion of a manhole against entering liquid comprising:

a skirt having inner walls extending down from the manhole;

a plate having an outer edge for sealing against the walls of the skirt the plate defining an opening;

a removable lid for effecting a seal at the opening of the plate within the manhole and forming an enclosed space between the removable lid and the lower portion of the manhole; and a relief valve on the plate having an inlet communicating with the enclosed space and an outlet communicating with an open space above the removable lid, the relief valve for preventing the enclosed space from overpressuring in the event that volatile gas collects within the enclosed space.

2. The assembly of claim 1 further comprising a conduit extending upwardly from the outlet of the relief valve.

3. An assembly for sealing a lower portion of a manhole against entering liquid, the manhole having a skirt and containing at least one pipe with a spill bucket, the sealing assembly comprising:

means fixed to the skirt for providing a supporting surface;

a sealing member resting on top of the supporting surface for providing a seal against the skirt and for providing a seal around the pipe by sealing to the spill bucket, the sealing member forming an enclosed space between the sealing member and the lower portion of the manhole;

a manhole cover having a lower face extending downwardly toward the sealing member;

a relief valve having an inlet communicating with the enclosed space and an outlet communicating with an open space above the sealing member, the relief valve for preventing the enclosed space from overpressuring in the event that volatile gas collects within the enclosed space; and a conduit extending upwardly from the outlet of the relief valve to a point near the lower face of the manhole cover.

* * * * *